US006336382B2

(12) United States Patent
Cerda

(10) Patent No.: US 6,336,382 B2
(45) **Date of Patent: *Jan. 8, 2002**

(54) RATCHET WRENCH HEAD MEMBER AND SYSTEM

(76) Inventor: Diego Cerda, 754 1/2 23rd St., Richmond, CA (US) 94804

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/047,010

(22) Filed: Mar. 24, 1998

Related U.S. Application Data

(60) Provisional application No. 60/044,075, filed on Apr. 17, 1997.

(51) Int. Cl.[7] ..... B25B 13/46

(52) U.S. Cl. ..... 81/60; 81/177.1; 81/177.2; 81/177.85

(58) Field of Search ..... 81/60, 177.1, 177.2, 81/177.85

(56) References Cited

U.S. PATENT DOCUMENTS

| | | | | | |
|---|---|---|---|---|---|
| 1,797,730 | A | * | 3/1931 | Pfauser | 81/177.1 |
| 2,112,693 | A | * | 3/1938 | Douglass | 81/57.44 |
| 3,881,377 | A | | 5/1975 | Evans et al. | 81/186 |
| D322,203 | S | | 12/1991 | Kanyuck et al. | D8/25 |
| 5,280,740 | A | | 1/1994 | Ernst | 81/177.7 |
| 5,582,083 | A | | 12/1996 | Baker | 81/119 |
| 5,584,220 | A | | 12/1996 | Darrah et al. | 81/57.29 |
| 5,873,289 | A | * | 2/1999 | Jarvis | 81/177.85 |

* cited by examiner

*Primary Examiner*—Timothy V. Eley
*Assistant Examiner*—Willie Berry, Jr.
(74) *Attorney, Agent, or Firm*—Gregory Smith & Associates

(57) ABSTRACT

A wrench head member has an attachment extension which allows the user to attach the wrench head member to a handle. The extension is a collar extending from the side of the wrench head member and having one or two holes extending through the sidewall of a hollowed section. The hollowed section is configured to engage a standard socket extension. Alternately, the wrench head member may have a post which engages a hollow within a handle member. The wrench head member may be a part of a wrench system or kit. The wrench head member has an attachment extension which allows the user to attach the wrench head member to a handle, preferably a socket extension. The attachment between the handle and the wrench head member is a male/female connection. Preferably, the wrench head is the female member having a collar extending from the side of the wrench head and having a pair of holes extending through the sidewall of the collar for the locking ball and release button on a socket extension. In an alternate embodiment, the wrench head member is the male member and the socket extension may be a modified version which provides a hollowed channel for a post extending from the wrench head member.

20 Claims, 5 Drawing Sheets

RATCHET WRENCH HEAD MEMBER AND SYSTEM

CROSS REFERENCE TO OTHER APPLICATIONS

This application claims the benefit of U.S. Provisional Patent Application No. 60/044,075 filed Apr. 17, 1997.

FIELD OF INVENTION

The present invention relates generally to an improved wrench head member, the wrench head member may be a part of a wrench system which is lighter and more compact than previous systems.

BACKGROUND OF THE INVENTION

Wrenches of assorted sizes and shapes have existed for decades. Most tool sets are bulky and of significant weight. A standard tool set has multiple handles, socket extensions, sockets, etc. Carrying or storing a full set of tools may be difficult due to its bulk and significant weight. In order to reduce the weight, the tool industry offers ratchet systems with a drive which fits several different socket extension. This allows a single handle to be used for several different configurations. However, there are still many bulky pieces which are redundant for any particular configuration.

To address the problems listed above, universal wrenches have been designed which fit multiple size bolts. There are several different variations of this type of device. One version has a rotatable head which rotates in relation to the handle to engage the bolt between the head and the handle as the user begins to twist the wrench. Another version has a sliding member which adjusts to the diameter of the bolt. Typically, these wrenches are more difficult to use, especially in situations where a 360° area surrounding the bolt is not free of interfering objects.

Another tool is a device sold by Mac Tools listed as part number W3R (Ratchet Head Only) and W30 H (Attachment Handle). The W3R device is a ratchet head which has a hollow round extension for a cylindrical handle. The extension has an opening for a locking button. The locking button on the handle is depressed with a screwdriver or other rigid device as the handle is inserted into hollow. When the handle is inserted and properly oriented, the locking button pops up into the opening in the extension. To remove the handle, a screw driver or other small, relatively rigid member is used to force the locking ball down as the handle is pulled out of the hollow. In order to maintain the locking ball within the opening, the movement of the ball must be extremely stiff, otherwise the handle would be prone to rotation within the hollow. Further, this device still requires the same number and variety of pieces and, therefore, would have the same problems with bulk and weight.

SUMMARY OF THE INVENTION

One embodiment of the present invention takes the form of a wrench head member having an attachment extension which allows the user to attach the wrench head member to a handle. In a preferred embodiment, the extension is a collar extending from the side of the wrench head member and having one or two holes extending through the sidewall of a hollowed section. The hollowed section is configured to engage a standard socket extension. Alternately, the wrench head member may have a post which engages a hollow within a handle member.

The wrench head member may also form part of a multi-piece, light-weight wrench system which provides a stable engagement between the assembled pieces of the wrench. The wrench is formed of two pieces: the wrench head member and a handle member. The wrench head member has an attachment extension which allows the user to attach the wrench head member to the handle. Although any elongate member may be used, the handle is preferably a socket extension. The attachment between the handle and the wrench head member is a male/female connection. Preferably, the wrench head is the female member having a collar extending from the side of the wrench head and having a pair of holes extending through the sidewall of the collar for the locking ball and release button on a socket extension. However, if preferred, the wrench head member may be the male member and the socket extension may be a modified version which provides a hollowed channel for a post extending from the wrench head member. Other variations and advantages of the invention will no doubt occur to those skilled in the art upon reading and understanding the following detailed description along with the accompanying drawings.

DETAILED DESCRIPTION OF THE INVENTION

Figure 1:
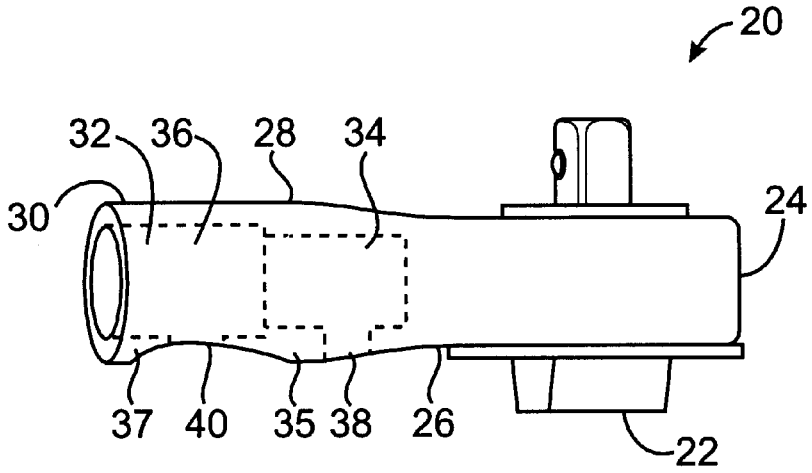
FIG. 1 is a side view of a quick-release ratchet wrench head member embodiment.
Figure 2:
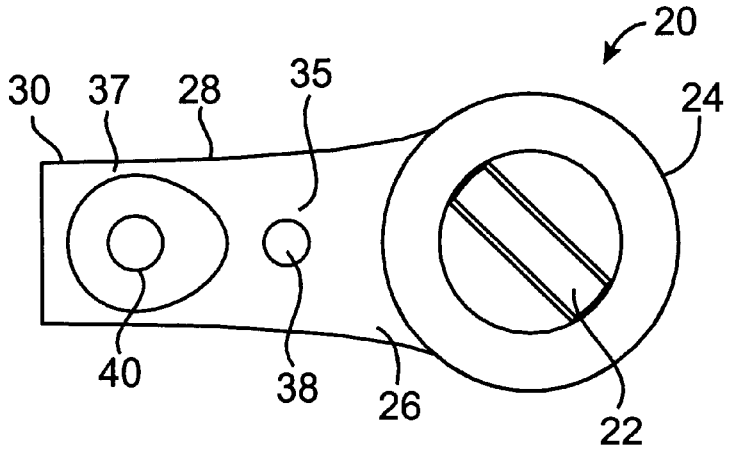
FIG. 2 is a top view of the quick-release ratchet wrench head member embodiment.
Figure 3:
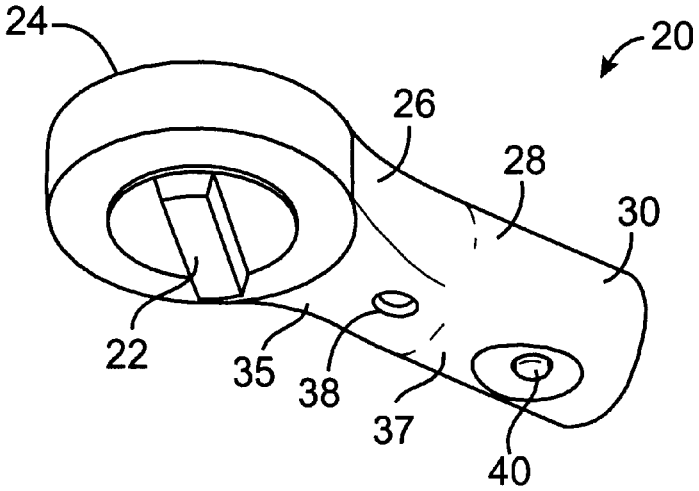
FIG. 3 is a top perspective view of the quick-release ratchet wrench head member embodiment.

FIGS. 1, 2, and 3 are side, top, and perspective views, respectively, of a quick-release ratchet wrench head member 20. In this embodiment, the wrench head member 20 is adapted to be used with a socket extension 50 having a quick-release button 56 which actuates the locking ball 54 on the drive 52 of a socket extension 50 (see FIGS. 4 and 5A–5D). Extension collar 28 extends from the base 26 of the wrench head 24. The lower portion 30 of the collar 28 is hollow and is configured to engage the socket extension 50. There are two sections of the hollowed portion 32: a drive hollow section 34 and a shaft hollow section 36. Closest to the wrench head 24 is the drive hollow 34, a square section which is configured to engage the drive 52 of the socket extension 50. Connecting to the drive hollow 34 is the shaft hollow 36 which is preferably round and configured to engage the shaft 58 of the socket extension 50. Optionally, the drive hollow 34 may be formed in alternate configurations such as hexagonal, star-shaped, etc. The only requirement is that the connection between the drive 52 and the drive hollow 34 inhibited turning within the collar 28.

A locking hole 38 is located through the sidewall 35 of the drive hollow 34 and is configured to engage the locking ball 54 on the socket extension drive 52. A release hole 40 is located through the sidewall 37 of the shaft hollow 36. The release hole 40 is for use with quick-release socket extensions 50 which have a release button 56 on the shaft 58 which, when depressed, allows the locking ball 54 on the drive 52 of the socket extension 50 to depress.

In the present embodiment, the release hole 40 is a wide shallow hole to allow easy access for a user's thumb or finger. In alternate embodiments, the sides of release hole 40 may have different slopes or shapes to fit particular uses or tools.

Figure 4:
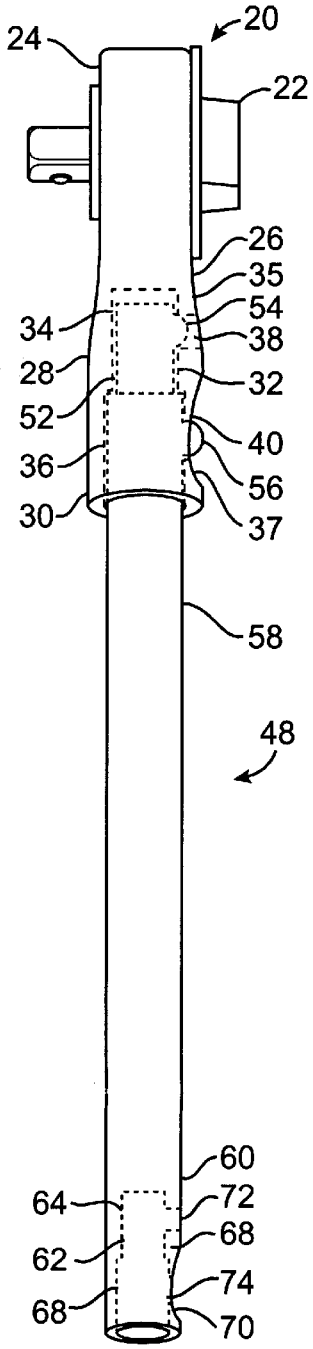
FIG. 4 is a side view of the quick-release ratchet wrench head member attached to a modified socket extension.
Figure 5A:
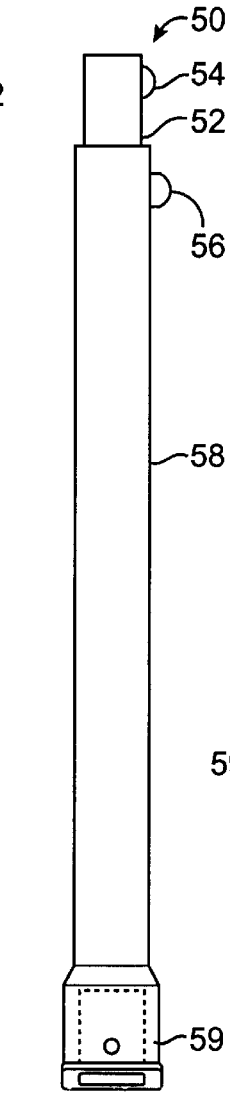
(PRIOR ART) FIG. 5A
FIGS. 5A–D are side views of assorted socket extensions.
Figure 5B:
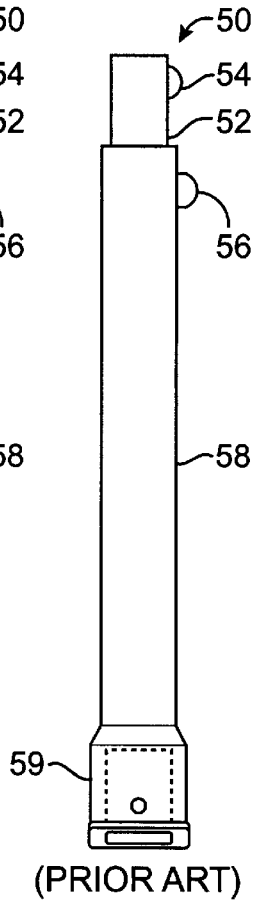
(PRIOR ART) FIG. 5B
Figure 5C:
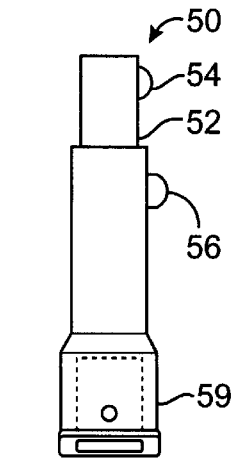
(PRIOR ART) FIG. 5C
Figure 5D:
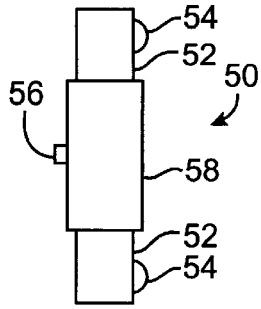
(PRIOR ART) FIG. 5D

FIG. 4 is a side view of the first ratchet wrench head member 20 attached to a modified quick-release socket extension 48. The drive end 52 of the socket extension 48 is received within the hollowed portion 32 of the collar 28. The collar 28 of the wrench head member 20 provides a stable engagement between the socket extension 48 and the wrench head member 20. The locking ball 54 is locked within the locking hole 72 and prevents the socket extension 48 from pulling out of the wrench head member 20 unless the release button is depressed. The engagement between the drive 52 and the drive hollow 34 prevents the socket extension 48 from rotating within the collar 28. The overall engagement between the hollowed portion 32 and the drive 52 and shaft 58 of the socket extension 48 transfer the torque forces from the socket extension 48 to the wrench head 24. Currently, the collar 28 is between 1.0 and 4.0 inches in length, preferably between 1.5 and 3.0 inches, most prefered between 1.5 and 2.0 inches. However, alternate embodiments may have longer or shorter collars 28 to prove the amount of stability necessary.

The locking ball 54 on the drive 52 is released by pressing a finger or thumb through the release hole 40 to depress the release button 56 on the shaft 58 of the socket extension 48. This embodiment of socket extension 48 is modified to fit a second socket extension 50 into its base 60. The base 60 of the socket extension 48 is a hollow 62 having two sections: a drive hollow 64 and a shaft hollow 68. Once again, a locking hole 72 passes through the sidewall 66 of the drive hollow 64 and a release hole 74 passes through the sidewall 70 of the shaft hollow 68. If desired, a user could place the drive 52 of a second socket extension 48 into the hollow 62 to form a longer handle, thereby increasing the lever arm to increase the amount of rotational force applied to the wrench head 24 without increasing the force exerted by the user.

FIGS. 5A–D are side views of assorted prior art socket extensions 50 which may be used with the present invention. The set of socket extensions 50 shown are of the release style having a release button 56 which a user presses to release the locking ball 54 on the drive 52. However, any type of socket extension 50 may be used with the present invention.

Figure 6:
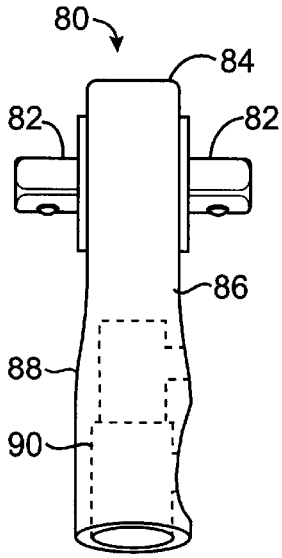
FIG. 6 is a side view of a wrench head member having two opposing drives.

FIG. 6 is a side view of a wrench head member 80 having two opposing drives 82. This style wrench head member 80 has two drives 82 that may be of the same or differing sizes. At the base 86 of the wrench head 84 is a collar 88 having a hollowed portion 90 configured to hold a socket extension 50 similar to the embodiment shown in FIGS. 1–3.

Figure 7A:
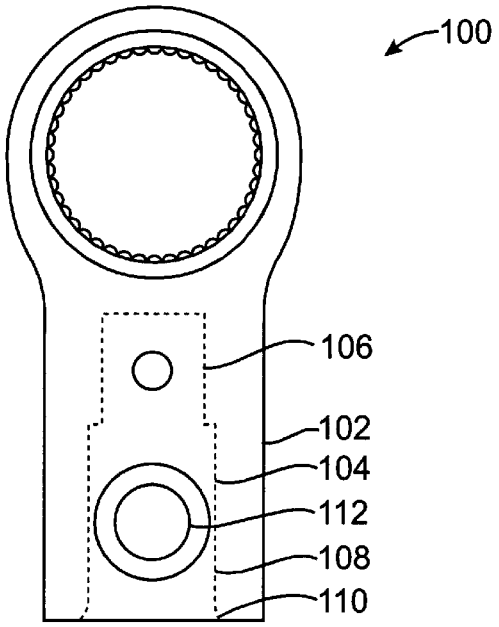
FIGS. 7A and B are front and side views of a closed-end, box ratchet wrench head member embodiment.
Figure 7B:
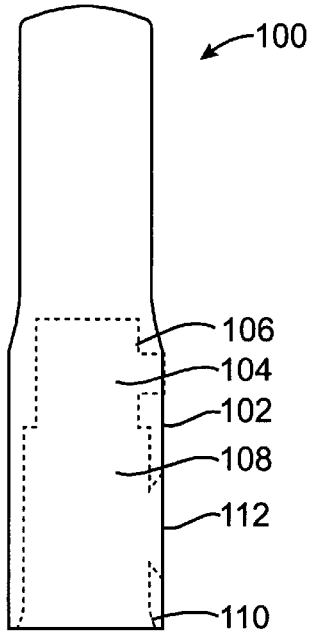

FIGS. 7A and B are front and side views of a closed-end, box ratchet wrench head member 100. The box may have any number of points to form the opening and may be fitted with a socket drive if desired. At the base of the wrench head member 100 is a collar 102 having a hollow 104 with two sections: a drive hollow 106 and a shaft hollow 108. In this configuration, the end of the shaft hollow 108 is tapered. The tapered section 110 guides the socket extension 50 into the hollowed portion 104 to facilitate easy insertion of the socket extension 50. The release button hole 112 has a steeper sidewall angle and has a circular shape for ease of manufacturing.

Figure 8A:
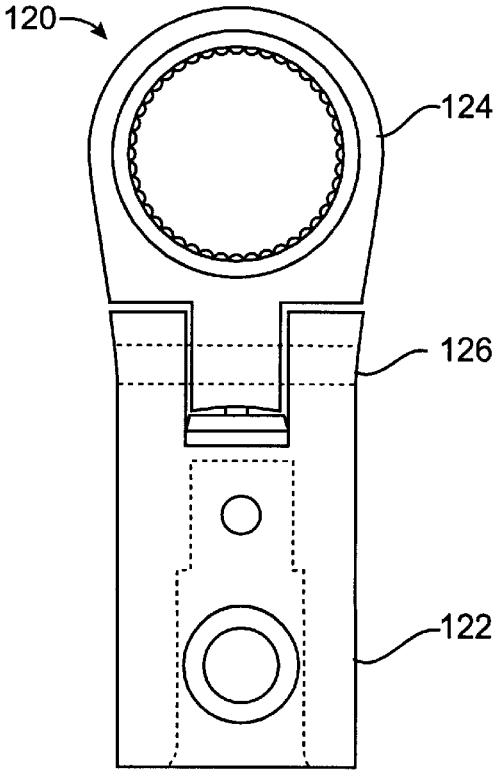
FIGS. 8A and B are front and side views of a flexible head, closed-end, box ratchet wrench head member embodiment.
Figure 8B:
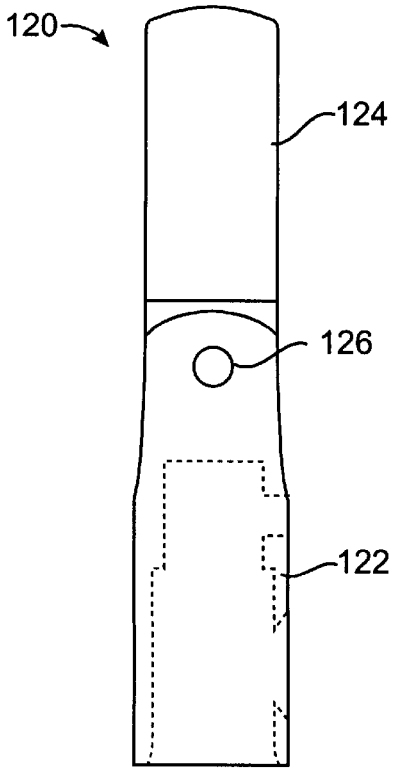

FIGS. 8A and B are front and side views of a flexible head, closed-end, box ratchet wrench head member 120 which is a variation of the embodiment shown in FIGS. 7A and B, but with the collar 122 connected to the wrench head 124 by a pivot 126 which pivots around a pivot point. The pivot 126 allows the user to choose the angle between the wrench head 124 and the collar 122, thereby choosing the angle between the wrench head 124 and a handle inserted into the collar 122.

Figure 9A:
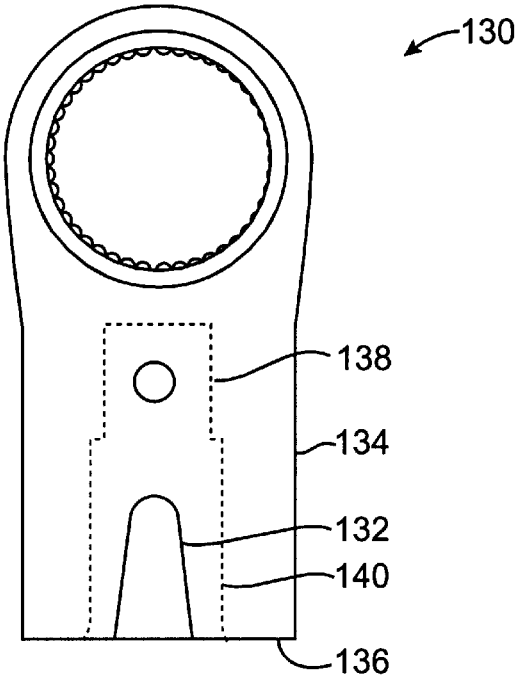
FIGS. 9A and B are front and side views of an alternate closed-end, box ratchet wrench head member embodiment.
Figure 9B:
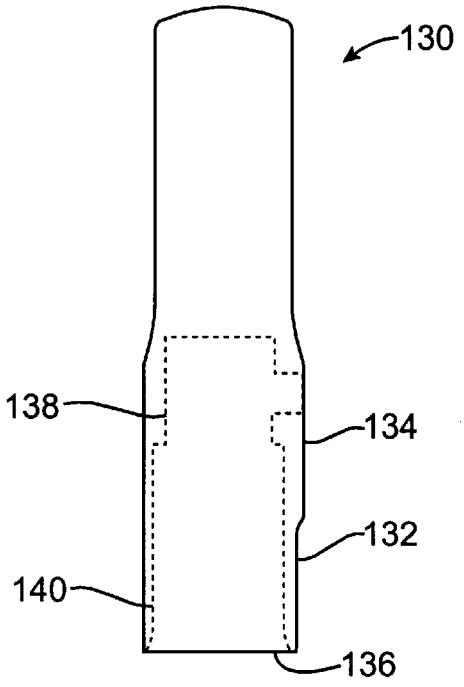

FIGS. 9A and B are front and side views of an alternate closed-end, box ratchet wrench head member 130 which is a variation of the embodiment previously described and shown in FIGS. 7A and B. In this case, the release button opening is a slot 132 extending from the end 136 of the collar 134. In the design shown, the slot 132 is tapered to guide the socket extension 50 into place within the hollowed portions 138, 140. The slot also assists the user in aligning the square drive 52 of the socket extension 50 with the square drive hollow 138. In alternate embodiments, the slot 132 may be a different shape for utilitarian or design purposes.

Figure 10A:
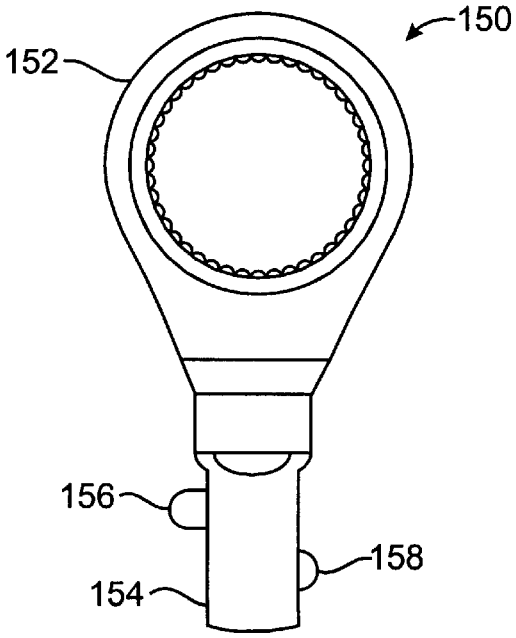
FIGS. 10A and B are front and side views of a closed-end, box ratchet wrench embodiment.
Figure 10B:
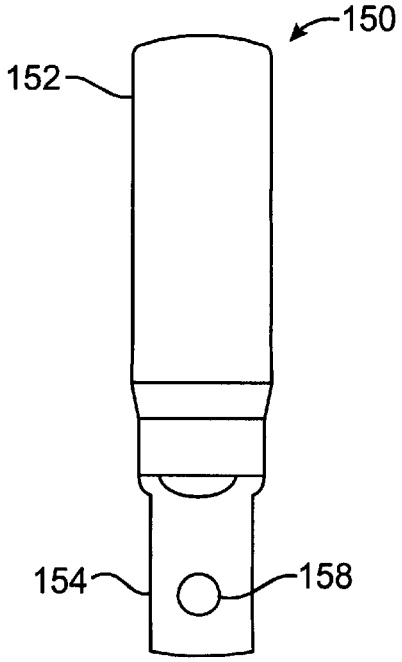

FIGS. 10A and B are front and side views of a closed-end, box ratchet wrench head member 150. The configuration shown is used with an alternate version of the socket extension, a version of which is shown as the base 60 of the socket extension 48 seen in FIG. 4. In this version, the wrench head 152 is attached to a post 154 which is configured to fit within a hollowed end 62 of the socket extension 48. The hollowed portion of the socket extension would have openings to accommodate the locking ball 156 and the release button 158.

Figure 11A:
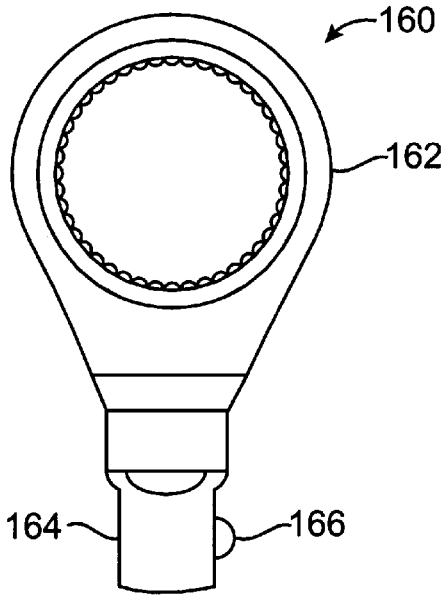
FIGS. 11A and B are front and side views of a closed-end, box ratchet wrench head member embodiment.
Figure 11B:
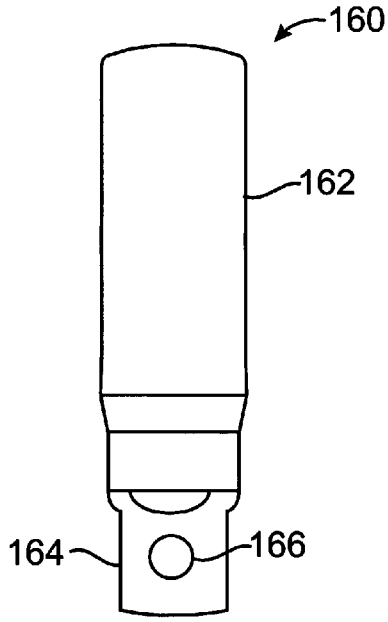

FIGS. 11A and B are front and side views of an closed-end, box ratchet wrench head member 160 which is a variation of the embodiment shown in FIGS. 10A and B. The wrench head 162 is connected to a post 164 which has a locking ball 166 located thereon. The socket extension 50 which corresponds to this embodiment 160 has an opening configured to engage the post 164 and locking ball 166.

Figure 12A:
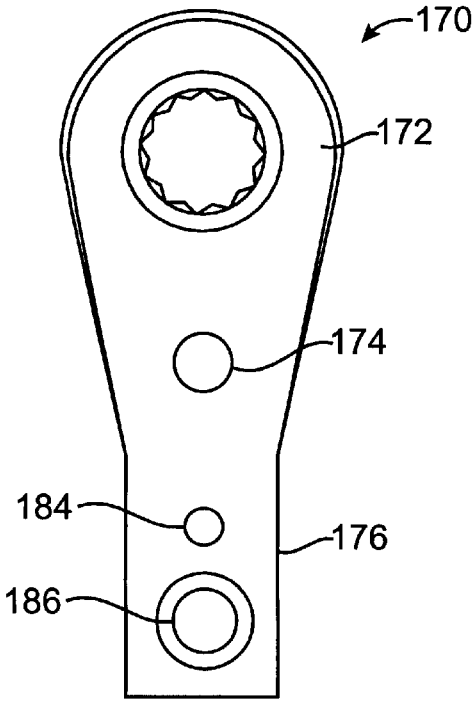
FIGS. 12A and B are front and side views of a quick-release, closed-end, box ratchet wrench head member embodiment.
Figure 12B:
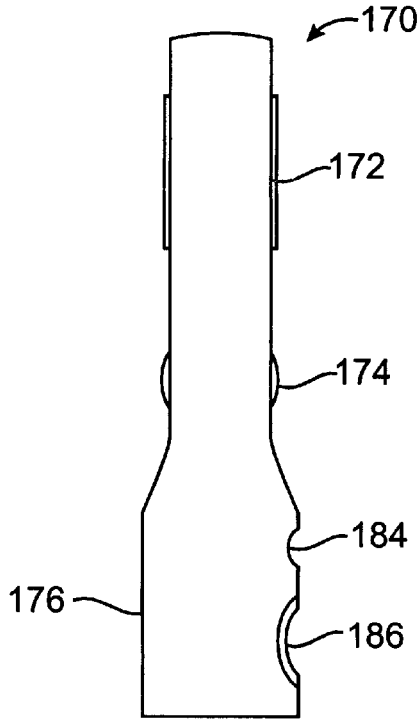

FIGS. 12A and B are front and side views of a quick-release, closed-end, box ratchet wrench head member 170. In this embodiment 170, the quick-release button 174 is located below the wrench head 172 and above the attaching collar 176. The attaching collar 176 has two holes: a locking ball opening 184 and a release button opening 186. These two openings 184, 186 lead into a hollow similar to those seen in other embodiments described herein.

The present invention is preferably forged steel, however alternate materials may also be used such as aluminum, and plastic with or without reinforcing, and alternate fabrication processes may be used such as casting, molding, machining, etc. depending on the strength and weight requirements.

The present invention is currently envisioned as a replacement for the traditional wrench handle assemblies in a standard wrench set and may be in standard sizes or dimensions such as ¼", ⅜", ½", and ¾". However, the dimensions may be increased or decreased or otherwise varied for alternate applications.

Although the examples given include many specificities, they are intended as illustrative of only one possible embodiment of the invention. Other embodiments and modifications will, no doubt, occur to those skilled in the art. Further, many features have been listed with particular configurations. Any one or more of the features may be added to or combined with any of the other embodiments or other standard tools to create alternate combinations and embodiments. Thus, the examples given should only be interpreted as illustrations of some of the preferred embodiments of the invention, and the full scope of the invention should be determined by the appended claims and their legal equivalents.

I claim:

1. A kit comprising:

a wrench head member comprising:

a wrench head, a collar having a first end and a second end, said first end being attached to a side of said wrench head, and a hollowed portion extending from said second end of said collar, said hollowed portion having a first section and a second section, said first section extending from said second end of said collar, said first section having a generally circular cross section, and said second section extending from said first section and having a generally square cross section; and at least one socket extension, wherein said first section of said hollowed portion is configured to hold a shaft of said socket extension and said second section of said hollowed portion is configured to hold a drive of said socket extension.

2. The kit of claim 1 wherein said wrench head member further comprises an opening within a sidewall of said hollowed portion of said collar, said opening being located to engage a locking ball on said drive.

3. The kit of claim 2 wherein said wrench head member further comprises a second opening within said hollowed portion of said collar, said second opening being located to engage a release button on said shaft.

4. A wrench head member, said wrench head member comprising:

a wrench head, a collar having a first end and a second end, said first end being attached to a side of said wrench head, a hollowed portion extending in from said second end of said collar, said hollowed portion having a sidewall, a first opening within said sidewall of said hollowed portion, and a second opening within said sidewall of said hollowed portion, wherein said second opening is a slot which extends from said second end of said collar.

5. The wrench head member of claim 4 wherein said hollowed portion has a first section and a second section, said first section extending in from said second end of said collar, said first section having a generally circular cross section and said second section extending from said first section and having a generally square cross section.

6. The wrench head member of claim 4 wherein said slot is tapered.

7. In combination:

a wrench head member having a wrench head, a handle member, a collar having a first end and a second end, and having a hollowed portion extending in from said second end, and a post having a locking ball proximate one end, said post being sized to fit within said hollowed portion, said collar being located at a position chosen from a side of said wrench head member and an end of said handle member, and said post being located on the other of said side of said wrench head member and said end of said handle member.

8. The combination of claim 7 wherein said hollowed portion has a first section and a second section, said first section extending in from said second end of said collar, said first section having a generally circular cross section, and said second section extending from said first section and having a generally square cross section.

9. The combination of claim 7 wherein said handle member is a socket extension.

10. The combination of claim 7 further comprising a first and a second hole extending through said collar.

11. In combination:

a socket wrench extension having a shaft section and a drive section extending therefrom; and a wrench head having a drive member and an extension collar, distinct from said drive member, extending from said wrench head, said extension collar having a hollow portion that includes a drive hollow portion configured for accepting and engaging said drive section of said socket wrench extension inserted therein and a shaft hollow section configured for accepting and engaging a portion of said shaft section of said socket wrench extension inserted therein, and wherein said drive section of said socket wrench extension is approximately square in cross section and said shaft section of said socket wrench extension is approximately circular in cross section, and wherein said drive hollow portion of said wrench head is approximately square in cross section for accepting and engaging said drive section of said socket wrench extension inserted therein and said shaft hollow portion of said wrench head is approximately circular in cross section for accepting and engaging a portion of said shaft section of said socket wrench extension inserted therein, whereby said wrench head is operated using said socket wrench extension as a handle by inserting said socket wrench extension into said hollow portion of said extension collar such that said drive section of said socket wrench extension engages said drive hollow portion of said extension collar and said shaft section of said socket wrench extension engages said shaft hollow portion of said extension collar.

12. The combination of claim 11 wherein said socket wrench extension includes a locking member extending from said drive section thereof, and wherein said wrench head further comprises an opening within a sidewall of said hollow portion of said extension collar, said opening being located to engage said locking member of said socket wrench extension.

13. The combination of claim 11 wherein said socket wrench extension includes a locking member extending from said drive section thereof and a release button that, when actuated, releases said locking member, and wherein said wrench head further comprises a first opening within a sidewall of said drive hollow portion of said extension collar and a second opening within a sidewall of said shaft hollow portion of said extension collar, said first opening being located to engage said locking member of said socket wrench extension and said second opening being located to provide access to said release button of said socket wrench extension.

14. The combination of claim 13 wherein said second opening is a slot.

15. The combination of claim 11 wherein said drive member of said wrench head further comprises a ratchet drive mechanism.

16. The combination of claim 11 wherein said drive member of said wrench head comprises a socket drive for engaging a wrench socket.

17. An improved wrench head member of the type having at least one drive member, wherein the improvement comprises:

an extension collar extending from said wrench head member, said extension collar having a hollow portion that includes a drive hollow portion, which is approximately square in cross section, for accepting and engaging a drive section of a socket wrench extension inserted therein and a shaft hollow section, which is approximately round in cross section, for accepting and engaging a portion of the shaft section of the socket wrench extension inserted therein, whereby said wrench head member is operated using the socket wrench extension as a handle by inserting the socket wrench extension into said hollow portion of said extension collar such that the drive section of the socket wrench extension engages said drive hollow portion of said extension collar and the shaft section of the socket wrench extension engages said shaft hollow portion of said extension collar.

18. The improved wrench head member of claim 17 further comprising:

an opening within a sidewall of said drive hollow portion of said extension collar, said opening being located to engage a locking member extending from the drive section of the socket wrench extension.

19. The improved wrench head member of claim 17 further comprising:

a first opening within a sidewall of said drive hollow portion of said extension collar and a second opening within a sidewall of said shaft hollow portion of said extension collar, said first opening being located to engage a locking member extending from the drive section of the socket wrench extension and said second opening being located to provide access to a release button located on the shaft section of the socket wrench extension.

20. The improved wrench head member of claim 17 wherein at least one drive member comprises a first drive member and a second drive member mounted on opposite sides of said wrench head member.

* * * * *